US007309286B2

(12) United States Patent
Hedrick et al.

(10) Patent No.: US 7,309,286 B2
(45) Date of Patent: Dec. 18, 2007

(54) GAMING DEVICE HAVING A CO-MOLDED SWITCH AND METHOD OF MAKING SAME

(75) Inventors: Joseph R. Hedrick, Reno, NV (US); Tai Rosander, Reno, NV (US)

(73) Assignee: IGT, Reno, NV (US)

( * ) Notice: Subject to any disclaimer, the term of this patent is extended or adjusted under 35 U.S.C. 154(b) by 130 days.

(21) Appl. No.: 10/661,396

(22) Filed: Sep. 12, 2003

(65) Prior Publication Data

US 2005/0059490 A1 Mar. 17, 2005

(51) Int. Cl.
*A63F 9/24* (2006.01)

(52) U.S. Cl. ..... 463/37; 273/148 R

(58) Field of Classification Search ..... 463/1, 463/36–38, 47; 273/148 R, 148 B; 345/156–161; 242/385.1, 385.2, 385.3, 385.4, 371
See application file for complete search history.

(56) References Cited

U.S. PATENT DOCUMENTS 5,011,149 A * 4/1991 Purnell ..... 273/148 B
5,168,969 A * 12/1992 Mayhew ..... 191/12.2 R
5,232,191 A 8/1993 Infanti
5,382,767 A * 1/1995 Takano et al. ..... 200/531
5,489,010 A * 2/1996 Rogers ..... 191/12.2 R
5,579,002 A * 11/1996 Iggulden et al. ..... 341/23
5,762,617 A 6/1998 Infanti
5,913,487 A * 6/1999 Leatherman ..... 242/378.4
6,091,066 A 7/2000 Sugihara
6,120,025 A * 9/2000 Hughes, IV ..... 273/148 B
6,270,410 B1 * 8/2001 DeMar et al. ..... 463/20
6,293,485 B1 * 9/2001 Hollowed ..... 242/385.3
6,422,670 B1 7/2002 Hedrick et al.
6,454,649 B1 9/2002 Mattice et al.
D474,183 S * 5/2003 Mesa ..... D14/413
6,638,166 B2 * 10/2003 Hedrick et al. ..... 463/20
2002/0123381 A1 * 9/2002 Akeripa ..... 463/36
2002/0167486 A1 11/2002 Tan et al.
2003/0050117 A1 3/2003 Silva et al.
2003/0119543 A1 6/2003 Kfoury et al.
2003/0216174 A1 11/2003 Gauselmann
2004/0038725 A1 2/2004 Kaminkow
2004/0118669 A1 6/2004 Mou
2004/0140617 A1 * 7/2004 Cordell ..... 273/292

OTHER PUBLICATIONS

Logical Extension Brochure, written by Rojami Gaming, dated 2002.

* cited by examiner

*Primary Examiner*—Robert E. Pezzuto
*Assistant Examiner*—Alex F. R. P. Rada
(74) *Attorney, Agent, or Firm*—Bell, Boyd & Lloyd LLP

(57) ABSTRACT

A gaming device having an extendable button and a co-molded switch. The apparatus and method includes inserting a pushbutton switch and connection cord into a mold. A first portion is formed around the cord by injecting a first material onto the cord proximate the button. A second portion is formed around the cord by injecting a second material onto the mold proximate the first portion.

46 Claims, 10 Drawing Sheets

GAMING DEVICE HAVING A CO-MOLDED SWITCH AND METHOD OF MAKING SAME

BACKGROUND OF THE INVENTION

The present invention relates in general to gaming devices having a game operable upon a wager. More particularly, the present invention relates to a buttons used to operate the gaming device.

Various types of gaming devices are currently used in gaming areas. As illustrated in FIG. 1, patrons usually stand or sit in a chair or stool 100 in front of the gaming device while playing the games thereon. Many times, stool 100 is mounted at a fixed distance from the gaming device. The chair or stool 100 includes a footrest 102. As seen in FIG. 1, when a player uses footrest 102 of stool 100, the player typically leans forward to play the gaming device. Continued play in the forward position can cause fatigue and a desire by the player to play while sitting in a different position.

U.S. Pat. No. 6,422,670 ("the '670 Patent") describes a gaming device with footrests, shown as gaming device 10 and footrests 12 in FIG. 2. Footrests 12 are a pair of angled surfaces disposed on a lower and front housing portion of the gaming device. The footrests are spaced apart and allow the player to brace himself/herself against gaming device 10 and lean backward in the stool. The player can therefore adjust his/her seating position from time to time while playing the gaming device.

The '670 Patent also describes briefly, at columns 8 and 9, an extendable bet button described herein as extendable play button 20. As seen in FIG. 2 of this application, when the player reclines to play gaming device 10, the player pulls retractable and extendable play button 20 from gaming device 10. Extendable play button 20 enables the player to play gaming device 10 in the reclined position.

Any such extendable play button will be subject to substantial wear and abuse. Accordingly a need therefore exists for an extremely durable, dependable and affordable extendable play button for a gaming device having a game operable upon a wager.

SUMMARY OF THE INVENTION

The present invention provides an apparatus and method for forming a co-molded switch for an extendable input device used with a gaming device, and the co-molded switch made by such an apparatus and method. The extendable input device includes a pushbutton and a rearwardly extending connection cord. The tether includes a first, rigid material that supports the pushbutton and a second, flexible material that surrounds a portion of the first material and which is comfortable for a player to hold and grasp.

The apparatus of the present invention includes a button or switch, such as a momentary or maintained spring-operated pushbutton. The button triggers one or more functions on the gaming device, such as max bet and play, repeat the bet and play, or simply, play. The switch is housed inside co-molded parts. A rigid part surrounds immediately and holds the switch. The rigid part includes first and second housings in one embodiment.

The second co-molded part is an elastomeric or soft cover that is adhered to a surface of one of the rigid housings in one embodiment. The first and second rigid housings also have features for attaching mechanically to the elastomeric cover. An armored or otherwise resilient flexible cable is held in place with respect to one of the first and second housings via a retaining nut, such as a rubber grommet.

One method of forming the co-molded switch includes molding the rigid housings and the elastomeric cover at the same or substantially the same time. A first material is molded to form the first and second rigid housings. The first material is a relatively rigid synthetic material in one embodiment. For example, the first material can be urethane, polycarbonate, polyvinyl chloride, polyvinyl acetate, acrylic combinations of same or other plastic. The second material is substantially simultaneously applied or molded around and adhered to the first material. The second material is soft such as synthetic rubber, natural rubber, foam, or combinations thereof. The first and second materials are then cured to form the co-molded switch.

An apparatus for forming the co-molded switch includes in one embodiment a processor, an injector, one or more material supplies and a mold. The injector is connected operably to the processor and is configured and arranged to simultaneously or substantially simultaneously inject different materials into a mold. The material supplies are connected operably to the processor and the injector and supply the first and second materials to the injector to form the co-molded switch for the extendable switch of the present invention.

The present invention also includes a reel assembly operable to meter out and recoil the cord of the extendable switch. The assembly includes a spring, a ratchet and other components as discussed below. The ratchet enables the switch to be extended to and set at multiple positions. The ratchet also includes at least one dead spot that enables the switch to be released from a set position. When released, the spring is biased to recoil the cord or the switch within the machine and thereby retract the switch towards the machine.

It is therefore an advantage of the present invention to provide an apparatus that enables a player to play a gaming device comfortably.

Another advantage of the present invention is to provide an apparatus that enables the player to shift positions while playing a gaming device.

Moreover, it is an advantage of the present invention to provide an apparatus that enables the player to recline with respect to and operate the gaming device.

A further advantage of the present invention is to provide a co-molded switch for use with an extendable input device of a gaming device.

Another advantage of the present invention to provide a method for making a co-molded apparatus.

Another advantage of the present invention is to provide an apparatus for making a co-molded apparatus.

Another advantage of the present invention is to provide a reel assembly that enables the switch to be extended to multiple set positions and released therefrom without having to pull the switch to a fully extended position before such release.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1:
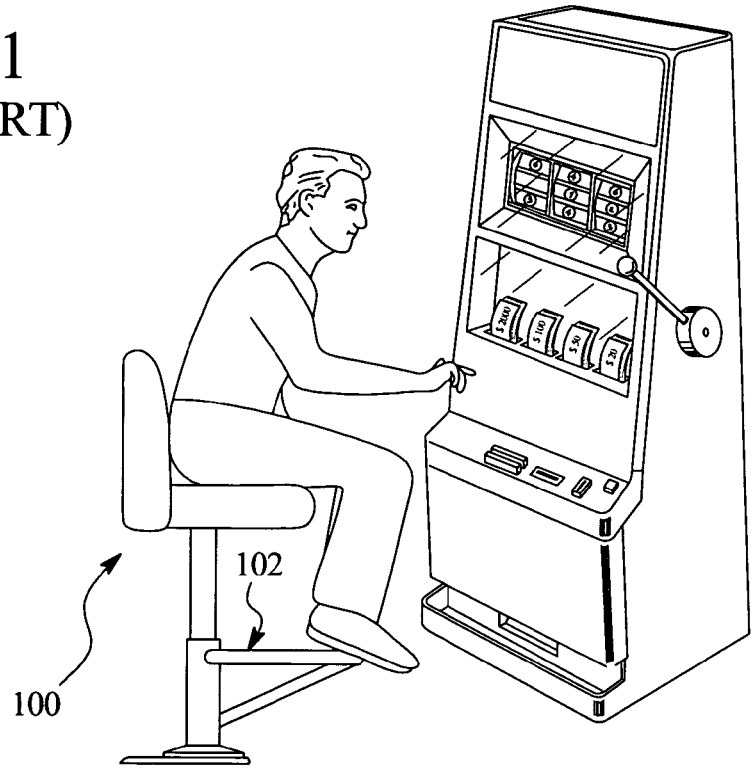
FIG. 1 (PRIOR ART)
FIG. 1 is a side elevation view of a known gaming device and a player sitting on a stool in front of the gaming device.
Figure 2A:
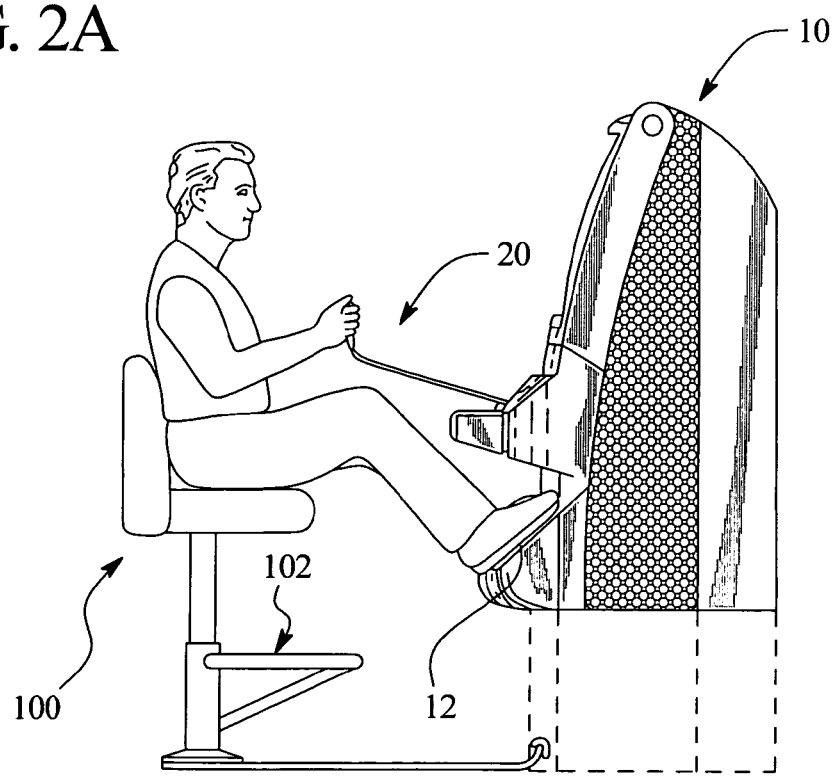
FIG. 2A is a side elevation view of a general embodiment of the present invention used with a gaming device illustrating the extendable input device and co-molded switch in an extended position.
Figure 2B:
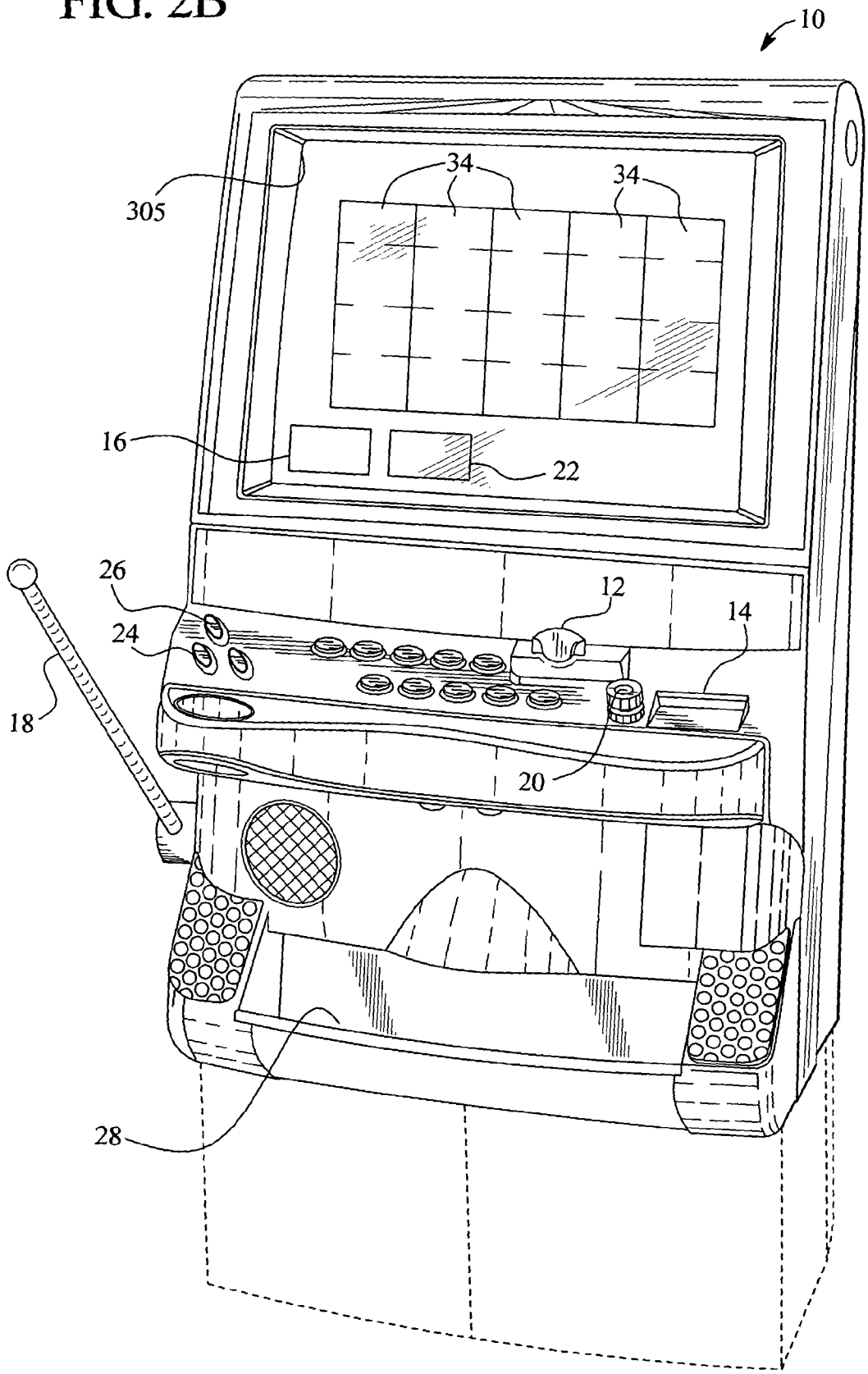
FIG. 2B is a front perspective view of the gaming device of FIG. 2A with the extendable input device and co-molded switch in a fully retracted position.

Referring now to the drawings, a gaming device 10 employing the present invention is generally illustrated in FIGS. 2A and 2B. Gaming device 10 is preferably has controls, displays and features of a conventional gaming machine. It is constructed so that a player can operate it while standing or sitting. The gaming device 10 may be mounted on a console; however, it should be appreciated that gaming device 10 can be constructed as a pub-style table-top game (not shown) which a player can operate while sitting. Furthermore, gaming device 10 can be constructed with varying cabinet and display designs.

Gaming device 10 can incorporate any primary or base game such as slot, poker, blackjack, lottery or keno, and any suitable secondary or bonus games. The symbols and indicia used on and in gaming device 10 may be in mechanical, electrical or video form.

Figure 5:
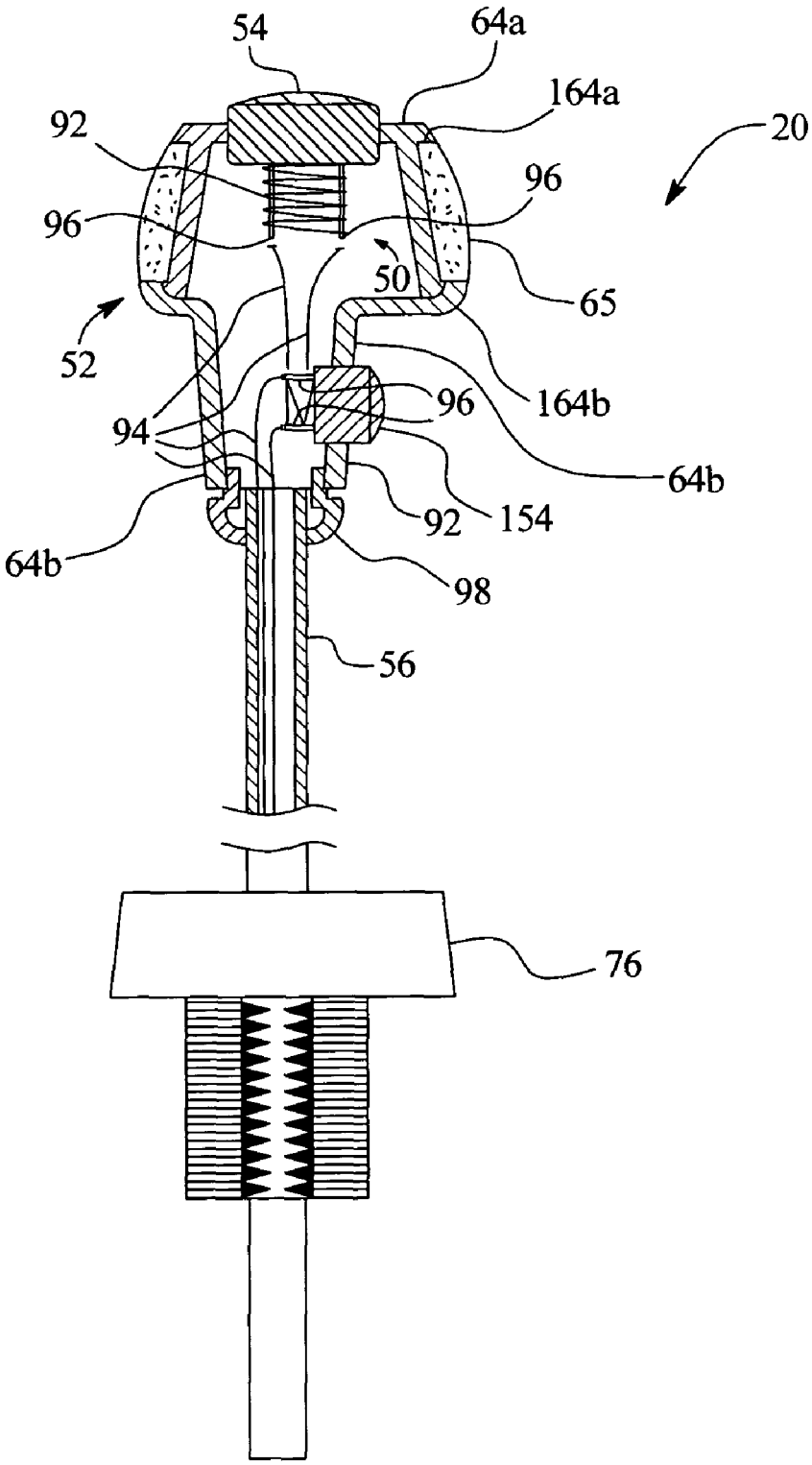
FIG. 5 is a sectional front elevation view of one embodiment of the co-molded switch and switch of the present invention.

Gaming device 10 generally includes a coin slot 12 and bill insertion slot 14, where the player inserts money, coins or tokens as illustrated in FIG. 2B. The player can place coins in the coin slot 12 or paper money or ticket vouchers in the bill insertion slot 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing an extendable play or bet input device 20 illustrated in FIGS. 2A and 2B. The extendable play input device 20 can be any action or play activator used by the player which activates or starts any game, action or sequence of events in the gaming device. As seen in FIG. 5 below, bet or play input device 20 can have multiple pushbuttons and trigger multiple different actions on gaming device 10.

As shown in FIG. 2B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may cash out and thereby receive a number of coins corresponding to the number of remaining credits by pushing a cash out button 26. When the player cashes out, the player receives the coins in a coin payout tray 28 or may alternatively receive payment in a different form such as a ticket. The gaming device 10 also includes one or more display devices 30, which can show primary games, bonus games and other displays, such as credit display 16 and bet display 22 in video format.

The general electronic configuration of the gaming device includes: a processor; a memory device for storing program code or other data; a central display device; an upper display device; a sound card; a plurality of speakers; and one or more input devices. The processor is a microprocessor or microcontroller-based platform which is capable of displaying images, symbols and other indicia such as images of people, characters, places, things and faces of cards. The memory device can include random access memory (RAM) for storing event data or other data generated or used during a particular game. The memory device can also include read only memory (ROM) for storing program code which controls the gaming device 10 so that it plays a particular game in accordance with applicable game rules and pay tables.

It should be appreciated that although a processor and memory device may be used in the gaming device, the gaming device can also be implemented using one or more application-specific integrated circuits (ASIC's) or other hard-wired devices, or using mechanical devices (collectively or alternatively referred to herein as a "processor"). Furthermore, although the processor and memory device reside on each gaming device 10 unit, it is possible to provide some or all of their functions at a central location such as a network server for communication to a playing station such as over a local area network (LAN), wide area network (WAN), Internet connection, microwave link, and the like. The processor and memory device are generally referred to herein as the "computer" or "controller."

With reference to FIGS. 2A and 2B, to operate the gaming device 10, the player inserts the appropriate amount of money or tokens at coin slot 12 or bill insertion slot 14 and then pushes the extendable play input device 20. The reels 34 will then begin to spin. Eventually, the reels 34 will come to a stop. As long as the player has credits remaining, the player can spin the reels 34 again. Depending upon where the reels 34 stop, the player may or may not win additional credits.

A player is shown in FIG. 2A sitting in a reclined position playing gaming device 10 using the extendable play input device 20 having the co-molded switch of the present invention. Using the extendable play input device 20 and co-molded switch 52 enables the player to play the gaming device in a comfortable, ergonomic position as illustrated in FIG. 2A, wherein the input device 20 is extended from gaming device 10.

Figure 4:
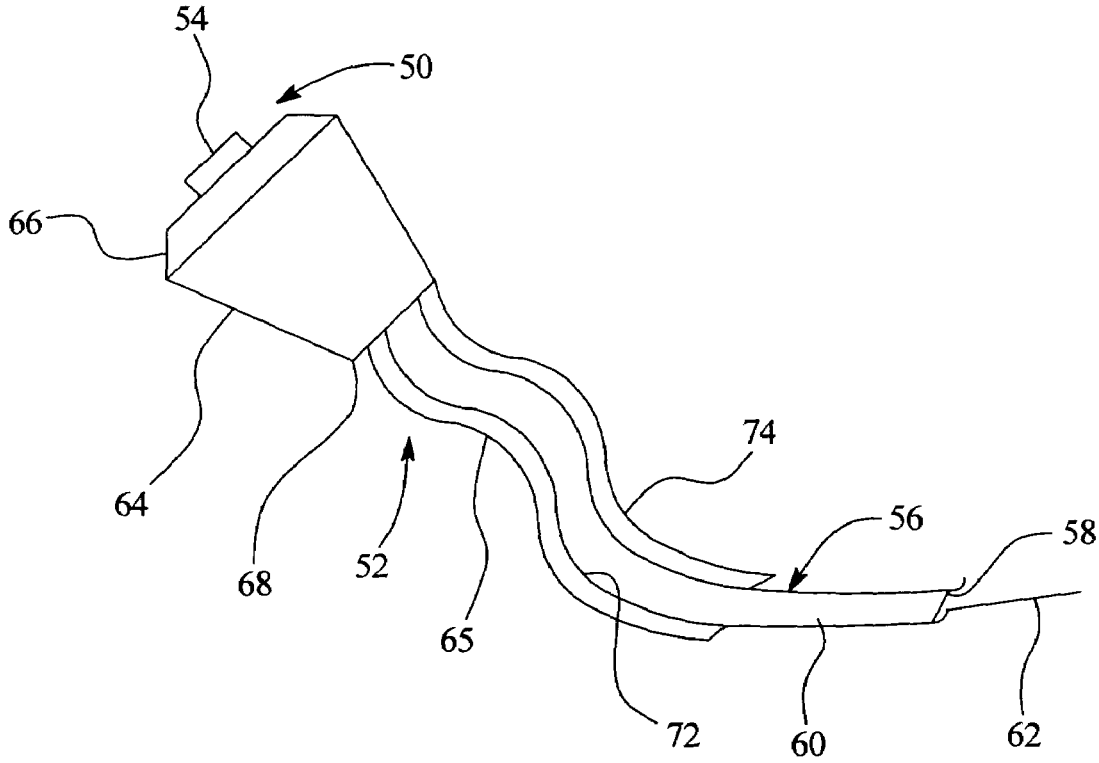
FIG. 4 is a partial cross-sectional side view of the extendable input device and co-molded switch of FIG. 3.

In one embodiment, the extendable play input device 20 includes an electrical portion 50 and co-molded switch 52 as illustrated in FIGS. 4 and 5. The electrical portion 50 includes a monetary or maintained pushbutton 54 with appropriate electrical connections and legends (not shown) and a flexibly extending member or connection cord 56.

In one embodiment, the cord 56 is a flexible stainless steel cord or armored cable that withstands readily the rigors of frequent gaming, pulling, pushing, liquid spill, cigarette ashes, etc. Cord 56 protects wiring that connects the pushbutton switch 54 to the controller. Cord 56 includes inner and outer surfaces 58 and 60 respectively, where the inner surface defines a conduit or lumen for receiving electrical wiring 62.

In the embodiment illustrated in FIG. 4, the co-molded switch includes first and second portions 64 and 65, respectively. First portion 64 is comprised of a generally hard material, especially when compared to second portion 65, which is comprised of a generally soft, flexible or malleable material which makes grasping extendable play input device 20 more comfortable. First portion 64 is able to be grasped comfortably by a patron and is able to survive being dropped or banged. Second portion is flexible to accommodate different patron playing positions and is sufficiently strong to protect the cord from damage caused by dropping it.

Figure 3:
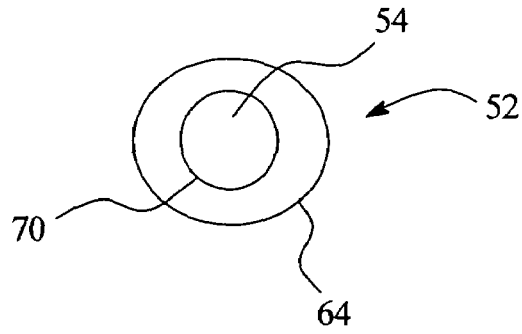
FIG. 3 is a top plan view of one embodiment of the extendable input device and co-molded switch in accordance with the present invention.

In FIG. 3, first portion 64 has a generally elliptical shape, when viewed from above as illustrated. It should be appreciated that other shapes are contemplated, including circular with or without finger indents to accommodate different players or different games. First portion 64 includes opposing first and second ends 66 and 68, respectively. The first end defines a first aperture 70 that accommodates the pushbutton switch. The second end defines a second aperture (not shown) that accommodates the cylindrical cord. It should be appreciated that first end has a larger diameter than second end as illustrated, but other embodiments are contemplated as discussed herein. First portion 64 can be made of any suitable moldable material which is relatively rigid, such as urethane, polycarbonate, polyvinyl chloride, polyvinyl acetate, acrylic and combination thereof, as well as other suitable relatively rigid plastics.

Second portion 65 has a generally tubular or cylindrical shape including inner and outer surfaces 72 and 74, respectively. The inner surface defines a conduit or lumen for receiving and contacting cord 56. In one embodiment, second portion 65 contacts or is connected to first portion 64 and the cord, and is comprised of any suitable soft or flexible material including synthetic rubber, natural rubber foam products or any other suitable soft, malleable or otherwise comfortable-feeling material.

Referring now to FIG. 5, one embodiment for extendable switch 20 is illustrated. Switch 20 of FIG. 5 includes the electrical portion 50, including the button 54. Switch 20 also includes the co-molded switch 52. Co-molded switch 52 is made up of upper rigid housing 64*a* and lower rigid housing 64*b*. Tether or switch 52 also includes elastomeric portion 65. Rigid housings 64*a* and 64*b* are made of any of the rigid plastics described above. The housings are snap-fitted together, welded together, glued together or otherwise mechanically or chemically fitted together. Separate housings 64*a* and 64*b* enable the electrical portion 50, including button 54, to be secured inside the housings before fitting the housings together.

In one embodiment, electrical portion 50 also includes a second button 154, which controls a different function than does button 54. For example, button 54 could trigger the play or spin of the game, while button 154 triggers a change in the player's wager, such as change number of paylines played, the wager per payline, or both. Switch 20 includes any suitable number of buttons, such as buttons 54 and 154, that control multiple game functions. Moreover, the switches can be of a type other than an on/off switch, such as a switch that toggles between positions, such as sets one to five paylines or credits per payline for the player's wager. The buttons 54 and 154 are spring activated as indicated by springs 92 and connect to the game processor through conduit 56 via wires 94. Buttons 54 and 154 include contacts 96 that make momentary or maintained electrical communication with wires 94 when the buttons are pressed.

Conduit 56 runs to and through grommet 76 as described in more detail below. Grommet 76 is a bulkhead-type connection to gaming device 10, which allows conduit 56 to slide in and out of gaming device 10 in a relatively sealed manner. On the other end of conduit 56, a retaining nut 98 is attached to lower rigid housing 64*b* and seals around conduit 56.

Upper and lower rigid housings 64*a* and 64*b* each include a lip 164*a* and 164*b* that help to hold soft elastomeric portion 65 in place. As specifically illustrated in FIG. 5, the upper and lower rigid housings 64*a* and 64*b* define a U-shaped cavity therein. A relatively elastomeric cover 65 is substantially disposed in the U-shaped cavity of the housing 64*a* and 64*b*. In addition, elastomeric cover 65 is molded over upper housing 64*a* and adheres to upper housing 64*a*. In that manner, soft cover 65 does not slide or rotate with respect to housing 64*a* when grasped and handled by the player. As before, the housings 64*a* and 64*b* and cover 65 are not limited to the "stick shift" or "joy stick" shape shown in FIG. 5. Those pieces, as well as buttons 54 and 154, can have any desired shape. For example, rigid housings 64*a* and 64*b* could be "gun handle" shaped, wherein soft cover 65 is placed about and adhered to the gun handle.

Figures 6, 7:
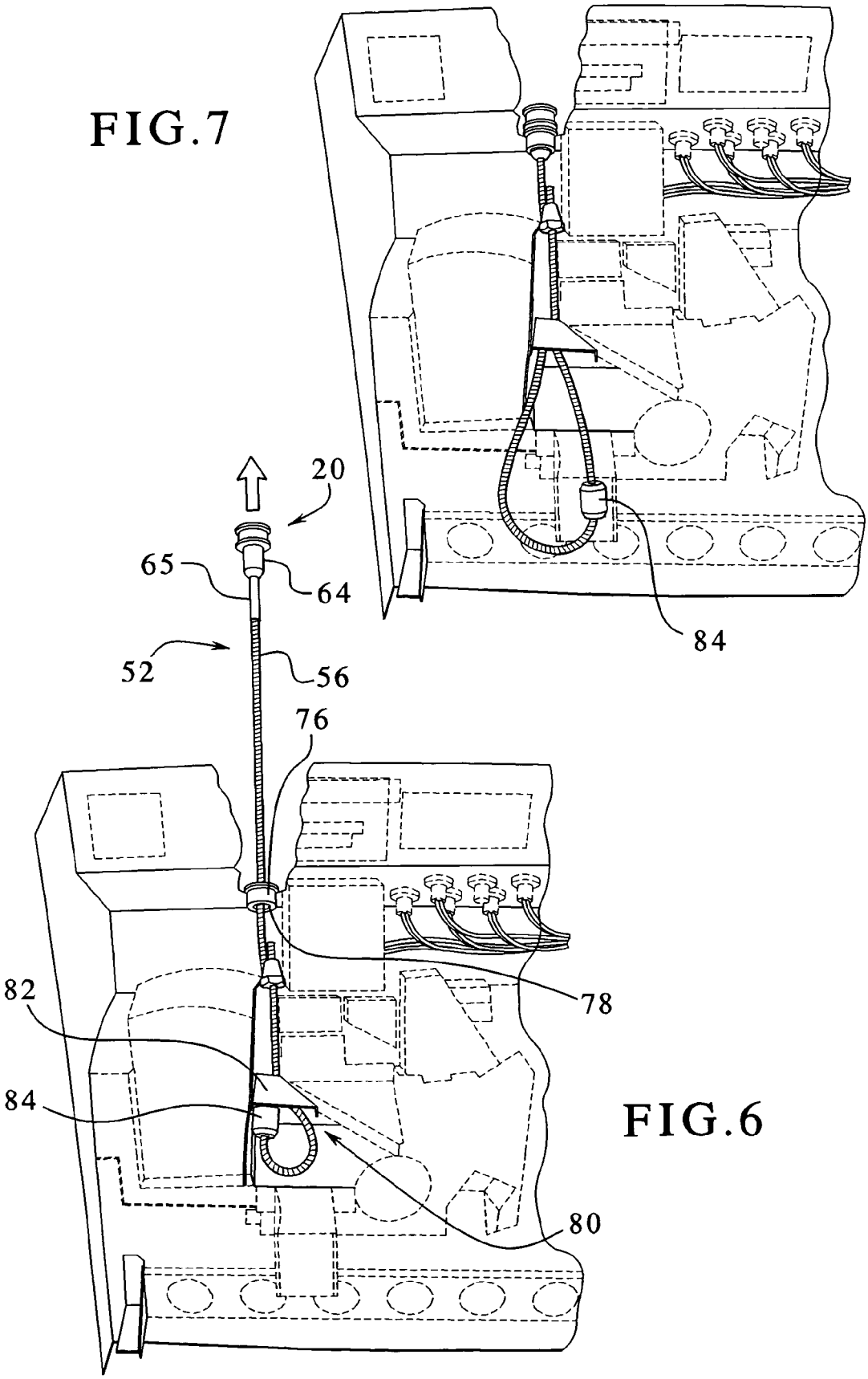
FIG. 6 is a fragmentary perspective view of the interior side of the gaming device of FIGS. 2 and 3, illustrating the extendable input device and co-molded switch of FIGS. 4 and 5 in the extended position.
FIG. 7 is a fragmentary perspective view of the interior side of the gaming device of similar to FIG. 6, illustrating the extendable input device and co-molded switch in the retracted position.

In a retracted form, conduit 56 of extendable button 20 is disposed mainly on the interior side of the lower front cabinet of the gaming device 10 as illustrated in FIG. 7. In FIG. 7, extendable play button 20 is in the fully retracted position, while FIG. 6 shows the extendable button 20 in extended position. The generally cylindrical grommet 76 discussed above is carried by the cabinet on the lower front portion thereof. The cylindrical grommet includes a central aperture 78 for receiving conduit 56, as described above and illustrated in FIGS. 6 and 7.

Gaming device 10 uses a stop assembly 80 to prevent the extended play button from being disconnected from the gaming device 10. In the illustrated embodiment, the stop assembly includes a bracket 82 defining an access area which enables the cord to freely slide through. A generally cylindrical weight 84 is attached at a pre-selected distance to the end of the cord, preventing axial forces from being placed on the electrical connection to the gaming machine while in the extended position. This cylindrical weight has a relatively larger diameter than the cord. In a normal position the weight rests in the interior of the lower front portion of the gaming device. When the co-molded switch is in an extended position, the diameter of the weight is much larger than the access to the bracket, preventing further movement on the armored cable stop as generally illustrated in FIG. 6.

In one embodiment, the co-molded switch 52 of the present is formed in a two-step process. In FIG. 4, the pushbutton 54 and cord 56 are placed in a mold and the rigid material is applied proximate to the first end of the cord (i.e., the pushbutton). The soft material is then applied to the cord 56 and possibly to a portion of the rigid material in FIG. 4, proximate to the first material (i.e., the differing materials are provided sequentially). However, it is contemplated that the soft material is injected first and then the rigid material is injected subsequent thereto so that a portion of the rigid material covers a portion of the soft material (i.e., the differing materials are again provided sequentially). In another embodiment, the two separate and differing materials are injected into the mold simultaneously. The tether is allowed to cure, forming the co-molded switch of the present invention.

In FIG. 5, the upper and lower rigid housings 64*a* and 64*b* are molded separately. Soft cover 65 is co-molded with and to upper housing 64*a*. Soft cover can be molded to rigid housing 64*a* after housing 64*a* is cured. Alternatively, the materials can be molded directly together and cure at the same time.

Figure 8:
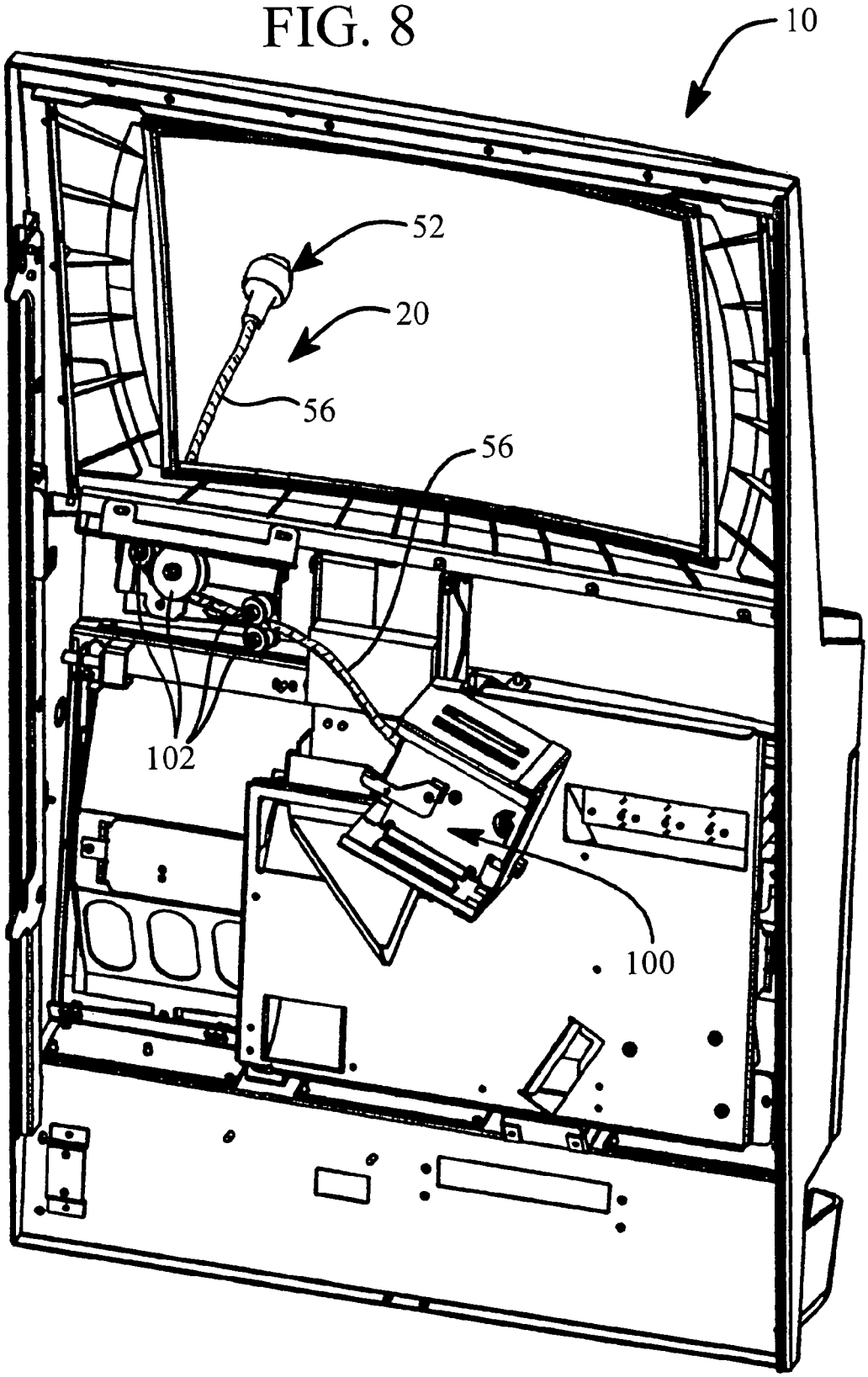
FIG. 8 is a fragmentary perspective view of the interior side of the gaming device, similar to FIGS. 6 and 7, illustrating one preferred embodiment for the recoiling mechanism operating with the extendable input device of the present invention.

Referring now to FIGS. 8 to 12, one alternative embodiment for enabling the input device 20 to be extended and retracted is illustrated. FIG. 8 shows the inside of the front panel or door of gaming device 10 and one of the positions for a reel assembly 100 of the present invention. In general, reel assembly 100 enables switch 52 and cord 56 of input device 20 to be extended or metered out from reel assembly 100 to a desired position, whereupon assembly 100 locks cord 56 and switch 52 at that desired position. When the player wishes to return switch 52 to the recoiled position at gaming device 10 or to change positions, reel assembly 100 recoils cord 56 and switch 52 or enables same to be extended further accordingly.

As described in more detail below, a ratcheting mechanism of reel assembly 100 includes a number of locking positions and at least one dead spot in which locking does not occur. The player feels such spots as the player pulls switch 52 and cord 56 and also when allowing input device 20 to recoil back into gaming device 10. One of those dead spots occurs when cord 56 has been pulled from gaming device 10 to the furthest point possible. That is, if the input device 20 is pulled to a furthest point and released, reel assembly 100 automatically recoils cord 56 and switch 52 of input device 20.

In FIG. 8, reel assembly 100 is illustrated as being tilted slightly upward, so that cord 56 exiting therefrom extends relatively linearly towards a set of rollers 102. Rollers 102 enable cord 56 to bend and move fluidly in and out of gaming device 10. The positioning and amount of rollers 102 can vary based on the placement of reel assembly 100 and the position on the front panel or door of gaming device 10 through which cord 56 passes.

Figure 9:
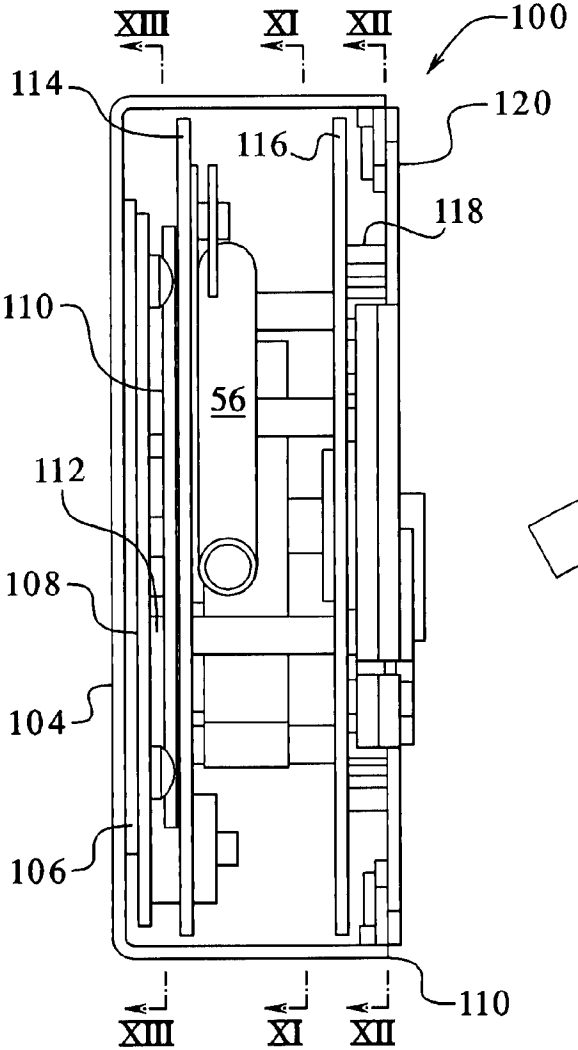
FIG. 9 is a side view of the reel assembly shown in FIG. 8.

FIG. 9 illustrates a side view of reel assembly 100. The view in FIG. 9 looks at the side of assembly 100 through which cord 56 exits and enters the assembly. FIG. 9 illustrates many of the components of reel assembly 100. Reel assembly 100 includes a base 104, which is part of an overall enclosure 110 for the assembly. A foam pad 106 is placed between base 104 and a fixed circuit board 108. The foam pad helps maintain electrical communication and protects fixed printed circuit board ("PCB") 108 and a rotating PCB 110 from vibrations due to shipping, use and maintenance.

At least one electrical connector, such as slip ring electrical connector 112, is attached to fixed PCB 108. A series of traces (not illustrated) are placed or formed on rotating PCB 110. The conductive traces are circular and make electrical contact at all times during rotation of PCB 110 with slip ring connector 112 on fixed PCB 108. Pad 106 maintains a constant positive pressure on the electrical connection between connector 112 of fixed PCB 108 and electrical traces formed rotating PCB 110.

Rotating PCB 110 is fixed to a first rotating member 114. Coil 56 and other apparatus described below are maintained between first rotating member 114 and second rotating member 116. Rotating members 114 and 116 and the apparatus maintained between same form a rotating sub-assembly within reel assembly 100. As illustrated in FIG. 9, a ratchet 118 is provided on the outside of second rotating member 116. Its use is discussed below. Enclosure 110 includes a cover 120 in addition to base member 104, which covers ratchet 118 and its operation.

Figure 10:
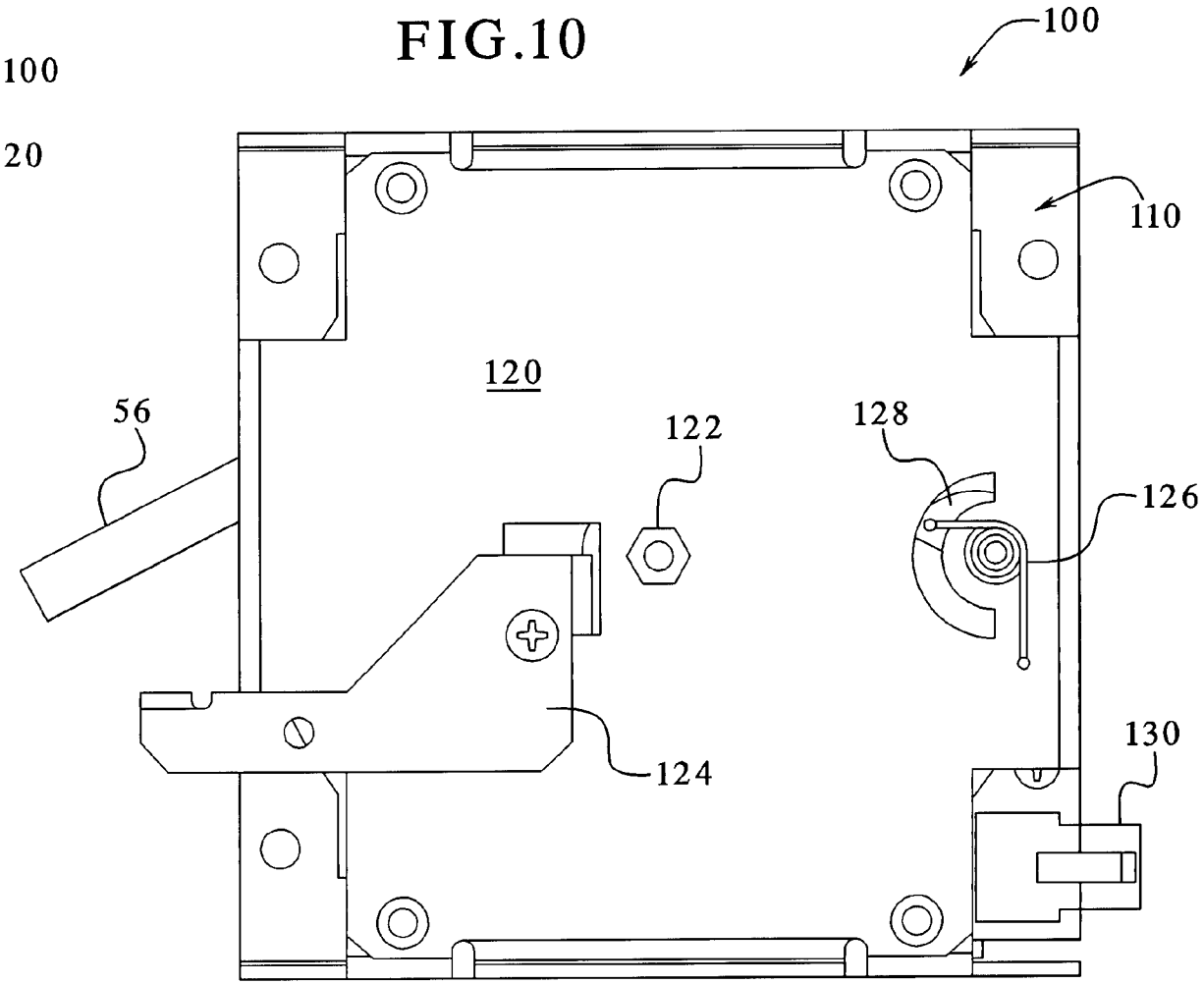
FIG. 10 is a front view of the reel assembly shown in FIG. 8.

FIG. 10 illustrates a front view of the outside of reel assembly 100, which is the face of the assembly shown most prominently in the perspective view of FIG. 8. For reference, a portion of cord 56 is shown extending from enclosure 110. In FIG. 10, a spring tensioning nut or adjuster 122 is provided on the outside of cover 120. Spring tensioning nut or adjuster 122 enables the operator to set the tension applied by a spring, shown below, which in turn sets the recoil force applied to cord 56 and switch 52. Tensioning nut or adjuster 122 also enables the reel assembly 100, cord 56 and switch 52 to be installed in a non-tensioned state. After installation, the operator sets the spring tension via nut or adjuster 122 and consequently the recoil force of assembly 100. The recoil force is set so that input device 20 returns to gaming device 10 in an efficient manner, but does not snap back too quickly, which could alarm or provide discomfort to the player.

The locking nut or adjuster 122 is connected to an axle 140 (illustrated in FIG. 11 below) positioned between cover 120 and base 104. Axle 140 is also connected to one end of a spring 132. The resulting assembly is constructed such that when the operator turns nut or adjuster 122 clockwise, the axle is also turned, which in turn winds the spring and increases the recoil tension on the reel. A ratchet 146 (illustrated in FIG. 12 below) is also attached to the axle. A locking lever 124 is connected rotatably to cover 120 or otherwise to enclosure 100 and enables the operator, after setting the tension nut and axle to the desired position and spring tension, to lock the axle and nut in place and maintain the desired spring tension. When in the locked position, locking lever 124 prevents the counterclockwise rotation (per orientation of FIG. 10) of ratchet 146, thereby fixing the position of the axle 140 relative to the enclosure 110. If the operator wishes to change the spring tension, the operator moves the locking lever 124 counterclockwise, disengaging the locking lever from the tooth of the ratchet 146, allowing the ratchet, axle and tensioning nut or adjuster to rotate freely. The operator is then able to set the tensioning nut or adjuster to the desired position and re-engage the locking lever.

A biasing member such as a pawl spring 126 is fixed at one end to cover 120 or other member of enclosure 110 and at another end to a pawl 128. Pawl 128 as shown in more detail below is operable to lock ratchet 118 in position when the ratchet moves in a coil-extending rotational direction. In that way, the player can pull input device 20 to a desired position and let pawl 128 engage the ratchet at the extended position and hold that position even if the player releases the grasp of device 20.

An electrical connector 130 is provided at a convenient place on the outer enclosure 110 to enable the electrical circuitry within reel assembly 100 and input device 20 to be connected to and communicate with the circuitry and processing of gaming device 10. Electrical connection of assembly 100 is discussed in more detail below in connection with FIG. 13.

Figure 11:
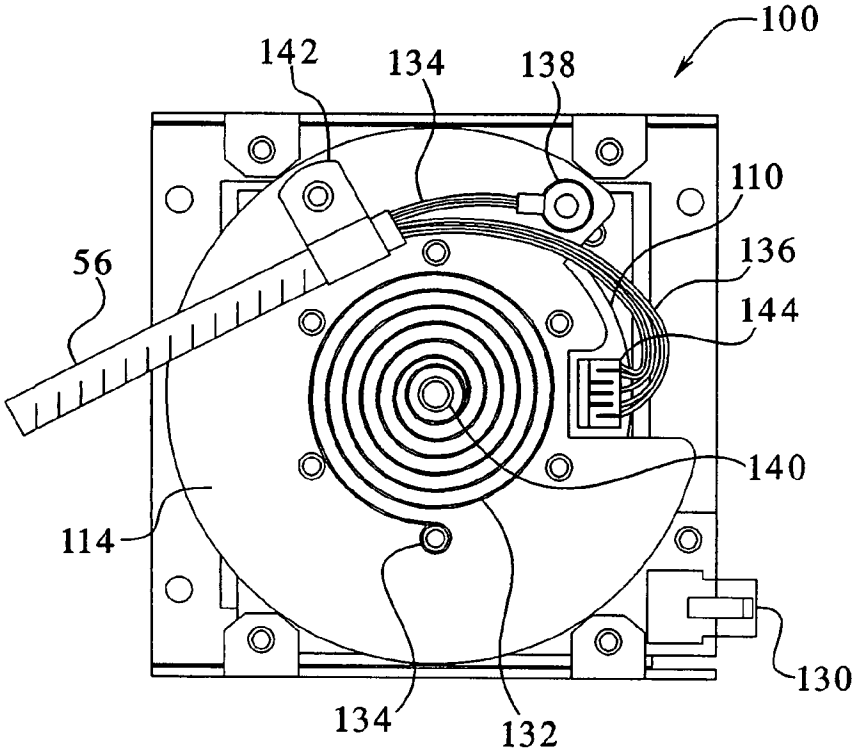
FIG. 11 is a front-sectional view of the reel assembly taken along line XI-XI in FIG. 9.

Referring now to FIG. 11, a front view of reel assembly 100 taken along a line XI-XI in FIG. 9 is illustrated. FIG. 11 views the front of assembly 100 with cover 120 and second rotating member 116 removed therefrom and illustrates the coil 56, a coil spring 132 and related apparatus. Coil spring 132, in one embodiment, is a flat piece of spring steel that is rolled and biased so that in a normal unstressed state, spring 132 tends to spread apart. Spring 132 connects at one end to a standoff 134, which in turn is attached to first rotating member 114. Indeed, a plurality of standoffs, like standoff 134, are provided on rotating member 114, so that coil 56 can wind around the standoffs without touching or interfering with the operation of spring 132. FIG. 11 shows reel assembly 100 in a fully unwound or extended state. Accordingly, coil 56 is not wound around or contacting any of the standoffs.

Coil 56, which in one embodiment is armored metal cable, can stretch. When the player pulls input device 20, the coil 56 and switch 52 are meant to move, not stretch. Accordingly, a non-elastic and strong cable 134 is placed inside coil 56 along with electrical and signal wiring 136. Cable 134, which can be braided or wound metal wiring, attaches at one end 138 to rotating member 114 and sets substantially the length of coil 56. Cable 134 attaches at its distal end to switch 52. When the player pulls switch 52, the manual force is thereby transferred via cable 134 and fixed end 138 to first rotating member 114. The transferred force in turn rotates member 114 about axle 140 (which is locked in place via lever 124). Spring 132 is connected at its inner end to the axle. Member 114, as well as member 116, rotates about axle 140 via suitable friction-reducing devices such as roller bearings, ball bearings or friction resistant, e.g., bronze or plastic bushings.

Cord 56 when pulled rotates member 114 in a counterclockwise direction with respect to the orientation of member 114 in FIG. 11, wherein standoff 134 rotates relative to the fixed axle 140 to close or more tightly coil spring 132. When cord 56 is released, spring 132 is biased to open from the more tightly coiled position shown in FIG. 11, which causes standoff 134 to be rotated clockwise about fixed axle 140. Spring 132 thereby rotates member 114, which wraps cord 56 about the standoff until cord 56 and switch 52 attached thereto are pulled inwardly into gaming device 10 to a fully retracted position, wherein switch 52 engages the front panel of gaming device 10.

In addition to strain relief cable 134, a tab 142 is coupled to the proximal end of cord 56 to rotating member 114. Tab 142 enables wires 136 to connect via connector 144 to rotating PCB 110 in a substantially stress-free manner, even when the wires 136 are rotating with member 114. Wires 136 are also positioned safely away from an area of the standoffs that receives the coiled cord 56.

Figure 12:
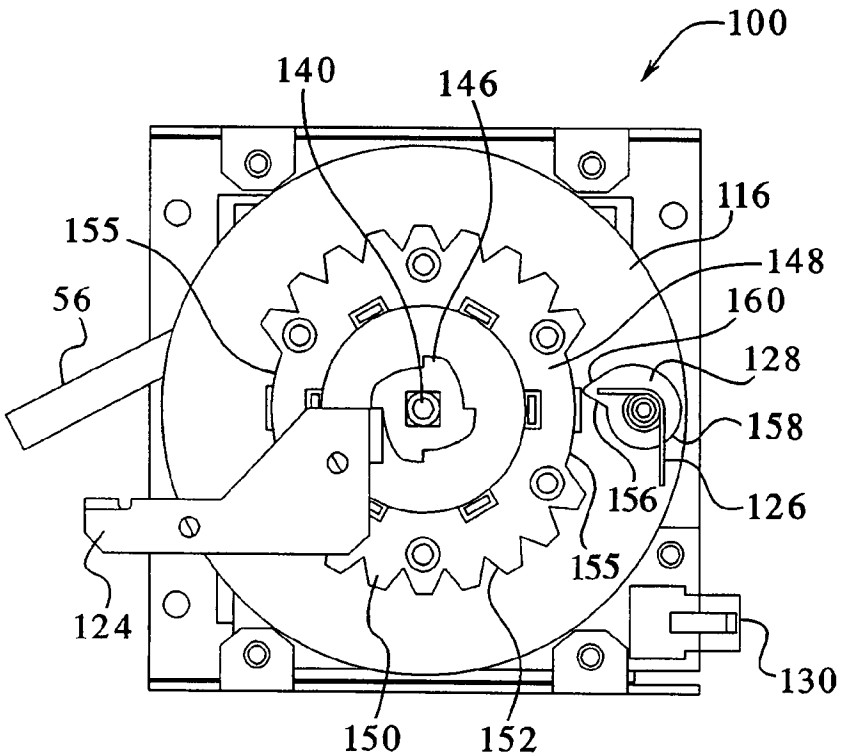
FIG. 12 is a front-sectional view taken substantially along line XII-XII of FIG. 9.

FIG. 12 illustrates a front view of reel assembly 100 taken along line XII-XII of FIG. 9. FIG. 12 shows the front of reel assembly 100 with cover 120 removed. FIG. 12 further illustrates the mechanical operation of reel assembly 100. As illustrated, axle 140 is attached to an inner ratchet 146. Ratchet 146 engages locking lever 124 when the operator moves lever 124 to fix and lock a particular tension setting made via tensioning nut 122.

A larger ratchet 148 is also connected rotatably to axle 140 and rotates with inner and outer rotating members 114 and 116. Ratchet 148 defines a number of gears or teeth 150 that operate in pairs to define a plurality of notches 152. Ratchet 148 also includes at least one, and in one embodiment a plurality of, smooth or dead area(s) 155. Dead areas 155 discussed above provide non-locking areas on ratchet 148.

Pawl 128 is connected to pawl spring 126, which in turn is connected to cover 120 or other fixed structure of assembly 100. Pawl 128 is shaped and configured to lock into one of the notches 152 when that notch engages pawl 128 from a counterclockwise (per orientation of FIG. 12) or paying-out rotational direction. Pawl 128 defines a flat edge 156 that makes an angle with rounded portion 158 of pawl 128. That angle or dip disallows the next or following tooth 150 from engaging pawl 148 before pawl snaps via spring 126 into one of the grooves 152. On the other hand, when teeth 150 of ratchet 148 rotate in the clockwise direction and engage an opposite surface 160 of pawl 128, which extends substantially tangentially from circular portion 158, the next or succeeding tooth 150 of ratchet 148 hits or contacts pawl 128 before the pawl can snap into one of the grooves 152. Therefore, when spring 132 pulls cord 56 into gaming device 10, and in turn rotates ratchet 148 in a clockwise direction per the orientation of FIG. 12, the ratchet continues to spin until the spring returns to its unbiased state or is halted by the player.

FIG. 12 illustrates cord 56 of assembly 100 in a fully extended state, i.e., when spring 132 is pulled apart and biased as much as possible. As illustrated, in that state one of the dead areas 54 is adjacent to pawl 158. In that way, when cord 56 is fully extended, i.e., pulled as far out of gaming device 10 as possible, and is released by the player, the cord 56 and switch 52 will automatically begin to recoil and continue to recoil until the system becomes fully recoiled or the player stops the recoil and, e.g., resets the switch to an intermediate setting.

The multiple dead areas indicated by smooth portions 155 of ratchet 148 create a noticeable tactile feel by the player, so that the player can tell intuitively that those areas are locking and/or unlocking. The player does not have to pull cord 56 from an intermediate locked position all the way to be fully extended to commence recoiling of the cord. The player instead only has to pull cord 56 to the next dead area, wherein pawl 128 does not engage ratchet 148, so that the force of spring 132 applied to cord 56 can begin the recoiling of same.

Figure 13:
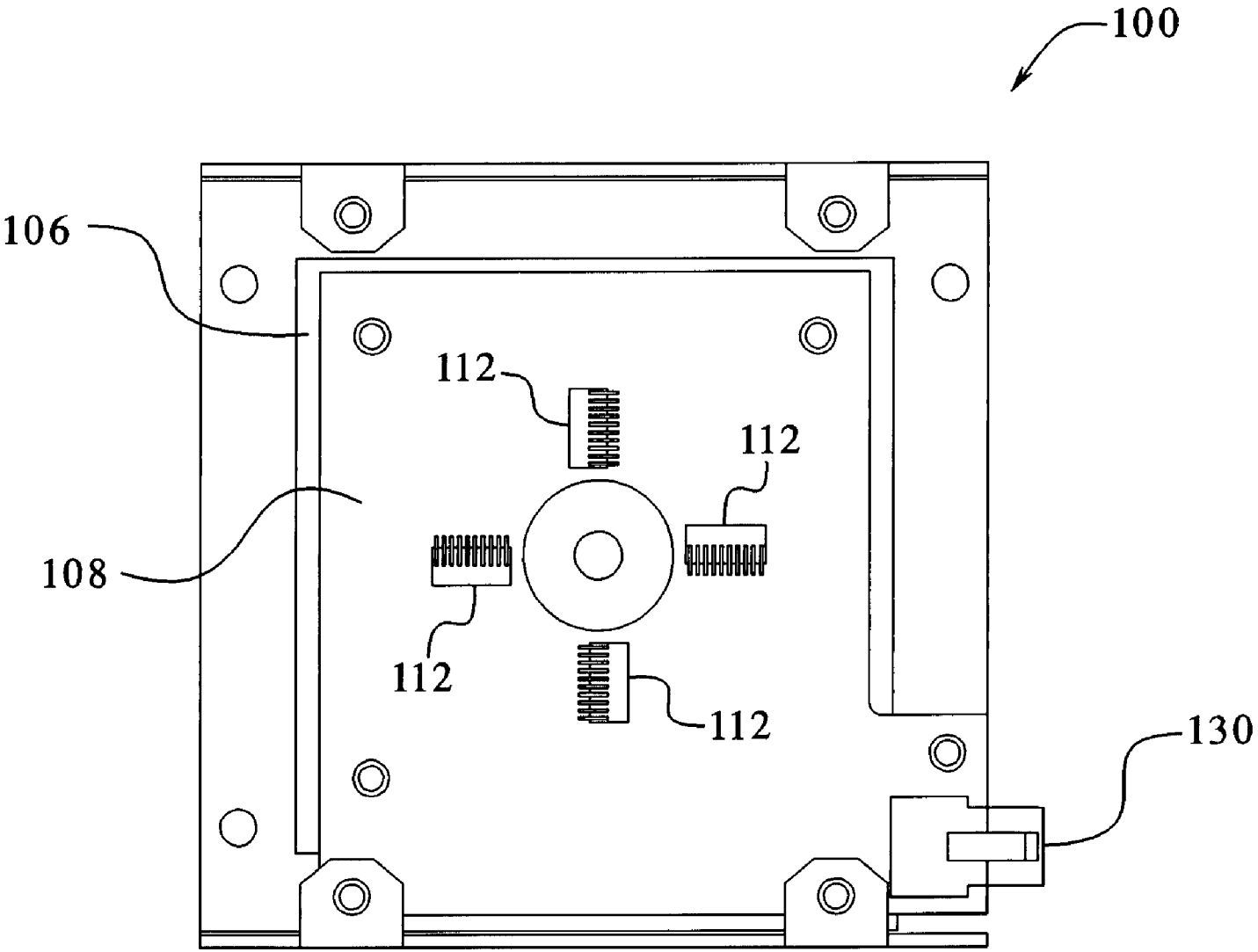
FIG. 13 is a front-sectional view taken substantially along line XIII-XIII of FIG. 9.

Referring now to FIG. 13, a front view of reel assembly 100 taken along line XIII-XIII is illustrated. Here, the majority of reel assembly 10 is cutaway to expose foam pad 106, fixed PCB 108 and slip ring connectors 112. As illustrated, reel assembly 100 includes four slip ring connectors 112 to ensure that at all times electrical contact exists between at least one of the connectors 112 and the circular traces on rotating PCB 110. The multiple slip ring connectors 112 compensate for any distortion, unevenness or wear in either fixed PCB 108 or rotating board 110.

Slip ring connectors 112 are electrically coupled to common wires or traces that run to signal connector 130, which is attached to fixed PCB 108. Connectors 112, the conductors running from connectors 112 to connector 130 and connector 130 enable the other electronics within gaming device 10 to communicate electrically with switch 52. The connectors enable power to run to a single switch or multiple switches as the case may be as well as one or more light emitting diodes ("LEDs") provided to illuminate faceplates or other indicia desirably illuminated on switch 52.

Figure 14:
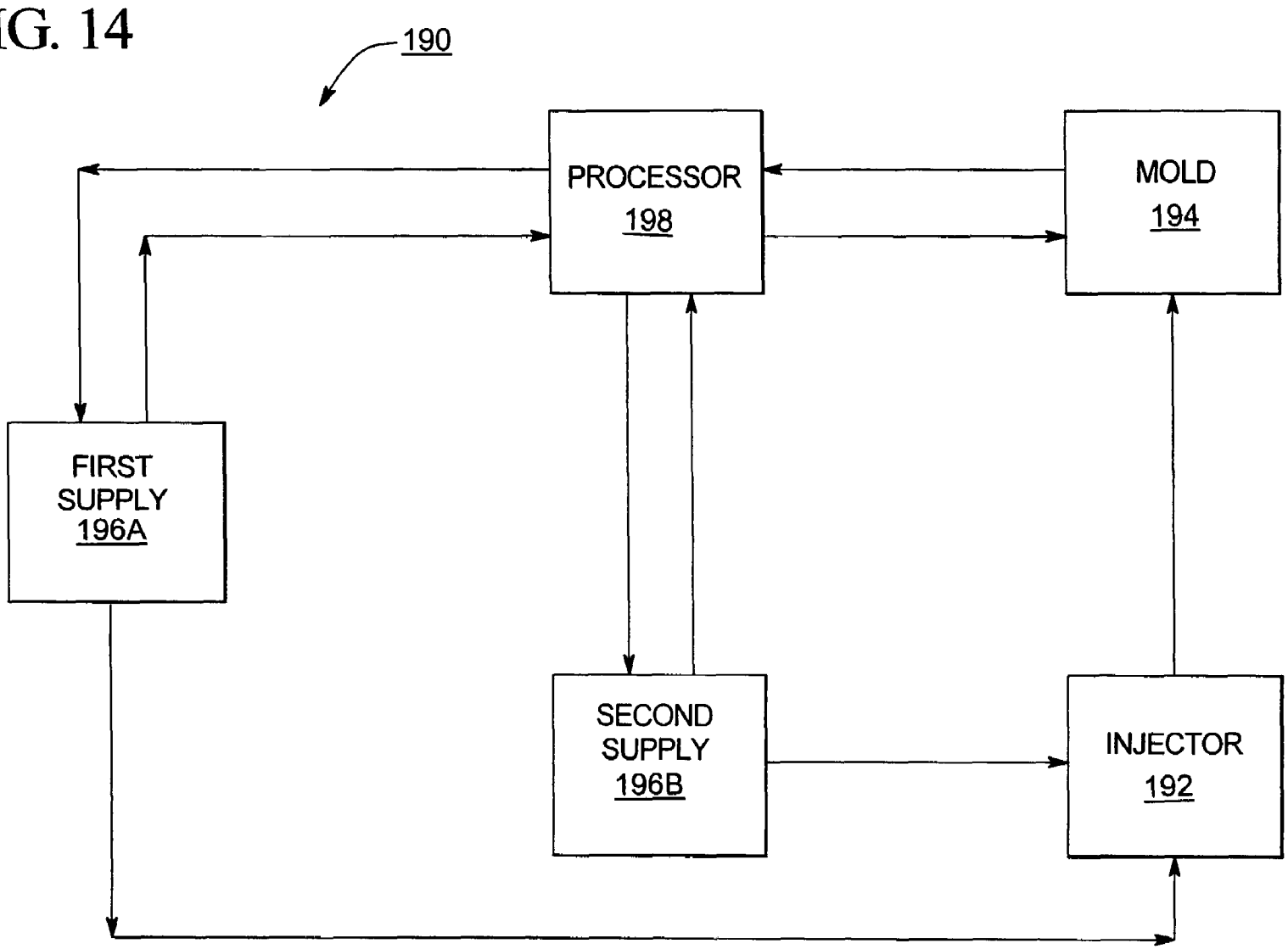
FIG. 14 is a block diagram of one embodiment of the apparatus for forming the co-molded switch of the present invention.

Referring now to FIG. 14, one embodiment of the apparatus for forming the co-molded switch is generally illustrated. The apparatus 190 of the present invention includes, in one embodiment: (i) a spray nozzle, a spray gun, or spray head or injection device (generally referred herein to as an injector 192); (ii) a mold 194; (iii) a first material delivery system or supply 196*a*; (iv) a second material or delivery system or supply 196*b*; and (iv) a processor 198 that operates and controls the injector and the supply in concert. The apparatus, including the injector, the mold and the supply are controlled by the processor, to simultaneously form or co-mold the tether used with a gaming device. It should be appreciated that while two supplies are illustrated, one supply containing both materials and generally designated 196 is contemplated.

The injector of the present invention simultaneously, or substantially simultaneously, distributes the material in a controlled manner to avoid waste. The injector includes a conventional injector housing in one embodiment and a conventional distributor or injector nozzle contained in the housing which is connected to the supply and processor. One or more tubes or other conduits are connected to the injector and the supply, enabling the apparatus 190 to apply the materials in single or plural applications.

The injector communicates with the processor, responding to on/off or proportional command signals, which control the timing and extent of operation. In a preferred embodiment, the injector has a predetermined application or injection rate, wherein the injector provides one material as supplied and then the other material. However, it should be appreciated that the injector includes two or more distributors or nozzles, enabling the injector to apply the differing materials simultaneously. The injector 192 communicates with the processor 198, providing status signals including, for example, signals representing the quality and/or quantity of the material injected.

The supply communicates with the processor and is in fluid communication with the injector through the various tubes or conduits. The supply provides a predetermined amount of each of the differing materials in suitable quantities to the injector as determined by the processor. The material is preferably supplied as needed, eliminating storage of the material in the injector, thereby reducing waste.

In one preferred embodiment, the supply satisfies the apparatus's pre-processing (i.e., storage and/or mixing) and transfer requirements of the material for particular applications. It should be appreciated that any suitable materials, including urethane, plastic, polyvinyl chloride, polyvinyl acetate, acrylic, synthetic rubber, natural rubber and foam products may be stored and provided by the supply.

The material is stored in one embodiment and used in apparatus 190 at a predetermined temperature and pressure appropriate for the differing materials, and fed under pressure to the injector. The supply responds to commands from the processor, providing operating status to the processor for safe and efficient operation. In one embodiment, the supply includes a conventional displacement pump and conventional pressure regulator. The pump operates at a relatively high pressure, and at some point in transport to the injector, the tubing and material are regulated to a lower pressure.

While the present invention is discussed with respect to an extendable play input device, alternative embodiments are contemplated, including an extendable bet one button and a combined extendable play button, bet one or max bet button. As discussed and shown above, the co-molded switch of the present invention could operate with two or more buttons, such as the play button and bet one button. In that embodiment, the player increases the bet using the bet one button on the co-molded switch 20 and then activates the play button of switch 20, which starts the game or sequence of events.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device comprising:
a cabinet;
a game operable upon a wager;
a processor operable to control the game; and
a switch connected extendably and retractably to the cabinet, the switch having a relatively rigid housing defining a U-shaped cavity therein and a relatively elastomeric cover substantially disposed in the U-shaped cavity of the housing, the switch including at least one button that is operable with the processor to control a function of the game and movable independent of the relatively elastomeric cover.

2. The gaming device of claim 1, wherein the switch is of a type selected from the group consisting of: maintained, momentary and multi-position.

3. The gaming device of claim 1, wherein the switch includes multiple buttons that operate multiple functions of the game.

4. The gaming device of claim 1, wherein the elastomeric cover is adhered to the U-shaped cavity of the housing.

5. The gaming device of claim 1, wherein the U-shaped cavity of the housing mechanically holds the cover in place.

6. The gaming device of claim 1, wherein the housing includes a multi-piece housing having multiple pieces.

7. The gaming device of claim 6, wherein the pieces are molded separately and wherein one of said pieces is co-molded with the cover.

8. The gaming device of claim 6, wherein said multiple pieces each mechanically hold the cover in place.

9. The gaming device of claim 1, wherein the function is selected from the group consisting of: a play function, a bet increment function, a max-bet function, a repeat the bet function, and a cash out function.

10. The gaming device of claim 1, wherein the elastomeric cover is molded to the rigid housing after the housing has cured.

11. The gaming device of claim 1, wherein the elastomeric cover and housing are simultaneously cured.

12. A gaming device comprising:
a game operable upon a wager;
a processor operable to control a game;
a cabinet; and
an extendable switch connected to the cabinet and in communication with the processor through a connecting cord and having a first co-molded material adhered to multiple surfaces of a second co-molded material in a substantially surrounding relationship with a portion of the cord, wherein the first co-molded material and the second co-molded material remain stationary relative to one another during operation of the extendable switch.

13. The gaming device of claim 12, wherein the cord is a flexible cord.

14. The gaming device of claim 12, which includes a strain relief wire positioned inside the cord to prevent the cord from unduly stretching.

15. The gaming device of claim 12, wherein the switch is a play button or a bet button.

16. The gaming device of claim 12, wherein the second material includes an elastomeric cover that is molded to the rigid housing after the first material has cured.

17. The gaming device of claim 12, wherein the first material is a rigid material selected from a group consisting of urethane, plastic, polyvinyl chloride, polyvinyl acetate and acrylic.

18. The gaming device of claim 12, wherein the second material is a flexible material selected from a group consisting of synthetic rubber, natural rubber and foam products.

19. The gaming device of claim 12, wherein the extendable switch is also retractable via a spring housed inside the cabinet.

20. The gaming device of claim 19, wherein the spring loaded switch can be set at least one extended position via a ratcheting mechanism.

21. A gaming device comprising:

a cabinet including at least one button operable by a person;

a game operable upon a wager;

a processor operable to control the game; and a switch connected extendably and retractably to the cabinet via a cord, a spring and a ratchet, wherein the spring causes the switch and cord to retract into a retracted position and the ratchet operates to lock the switch and cord in at least one extended position and wherein the switch is positioned in substantially the same plane as the at least one button of the cabinet when the switch and cord are moved into the retracted position.

22. The gaming device of claim 21, wherein the switch includes a relatively rigid housing and a relatively elastomeric cover disposed on the housing, the switch operable with the processor to control a function of the game.

23. The gaming device of claim 22, wherein the function is selected from the group consisting of: a play function, a bet increment function, a max-bet function, a repeat the bet function, and a cash out function.

24. The gaming device of claim 22, wherein the elastomeric cover is disposed on the housing via adhesion, mechanically or via a molding process.

25. The gaming device of claim 21, wherein the spring is a coil spring that uncoils as the switch and cord are extended and recoils as the switch and cord are retracted.

26. The gaming device of claim 21, wherein the spring and cord are attached to a rotating member that meters-out and rolls-up the cord when the switch and cord are extended and retracted, respectively.

27. The gaming device of claim 26, wherein electrical wires extending from within the cord attach electrically to the rotating member.

28. The gaming device of claim 26, wherein the rotating member makes electrical contact with a stationary member via electrical traces provided on one of the members and at least one electrical connector provided on the other of the members.

29. The gaming device of claim 26, which includes a strain relief cable attached to the member and the switch, the cable fixing substantially an overall length of the cord.

30. The gaming device of claim 21, which includes a spring loaded pawl fixed translationally with respect to the ratchet, the pawl operable to lock the ratchet into a fixed rotational position.

31. The gaming device of claim 30, wherein the pawl is operable to lock the ratchet when the ratchet rotates in a cord extending direction but not lock the ratchet when the ratchet rotates in a cord recoiling direction.

32. The gaming device of claim 21, wherein the ratchet defines at least one area that is configured not to engage a locking member, the area operable to commence recoiling of the spring-loaded switch.

33. The gaming device of claim 32, wherein the ratchet is arranged so that the non-engagement area is adjacent to the locking member when the switch is pulled to a fully extended position.

34. The gaming device of claim 21, which includes a tension setting device operable to increase or decrease the force applied by the spring.

35. The gaming device of claim 34, which includes a locking member operable to be moved by a person to fix the tension setting device at a desired position.

36. A gaming device comprising:

a cabinet including at least one operational button;

a game operable upon a wager;

a processor operable to control the game; and a switch connected extendably and retractably to the cabinet via a cord and a mechanism operable to enable the cord to be pulled by a person to multiple predetermined extended positions defined by the mechanism and then released by the person, wherein the cord in each of the extended positions will thereafter recoil automatically to a fully retracted position, wherein when the switch and the cord are moved into the fully retracted position, the switch is (i) positioned directly adjacent to the at least one operational button and (ii) operable by the person.

37. The gaming device of claim 36, wherein one of the extended positions is a fully extended position.

38. The gaming device of claim 36, wherein the mechanism recoils the cord automatically to the fully retracted position unless reset at an intermediate position by the person.

39. The gaming device of claim 36, wherein the mechanism is spring activated.

40. The gaming device of claim 36, wherein the multiple extended positions are first positions and which includes a plurality of second positions defined by the mechanism, each of the second positions operable to be self-maintaining when the switch is released from the person's grasp.

41. A gaming device operable under control of at least one processor, said gaming device comprising:

a game controlled by the at least one processor and operable upon a wager;

a cabinet; and an extendable switch connected to the cabinet and in communication with the at least one processor through a connecting cord, the extendable switch including first and second housing portions, wherein the first housing portion includes a first rigid material adhered to a relatively elastomeric material in a substantially surrounding relationship with a portion of the cord and wherein the second housing portion includes a second rigid material positioned in a substantially surrounding relationship with a different portion of the cord, the first rigid material, the second rigid material, and the relatively elastomeric material being simultaneously engageable by a person and remaining stationary during operation of the extendable switch.

42. A gaming device operable under control of at least one processor, said gaming device comprising:

a game controlled by the at least one processor and operable upon a wager;

a cabinet; and an extendable switch connected to the cabinet and operable with the at least one processor through a connecting cord to control a function of the game, the extendable switch including a first material adhered to a second material in a substantially surrounding relationship with a portion of the cord, wherein the first and second materials are simultaneously engageable by a person and remain stationary during operation of the extendable switch.

43. A gaming device operable under control of at least one processor, said gaming device comprising:

a cabinet including at least one operational button;

a game controlled by the at least one processor and operable upon a wager; and a switch connected extendably and retractably to the cabinet via a cord, a spring and a ratchet, wherein the spring causes the switch and cord to retract into a retracted position and the ratchet operates to lock the switch and cord in at least one extended position, wherein the switch is positioned directly adjacent to the at least one operational button and operable by a person when the switch and cord are moved into the retracted position.

44. A gaming device operable under control of at least one processor, said gaming device comprising:

a cabinet including at least one operational button;

a game controlled by the at least one processor and operable upon a wager; and a switch connected extendably and retractably to the cabinet via a cord, a spring and a ratchet including a plurality of co-acting teeth configured in pairs to define a plurality of notches, wherein the spring causes the switch and cord to retract into a retracted position and the ratchet operates to lock the switch and cord in at least one extended position, wherein the switch and the at least one operational button are positioned in substantially the same plane when the switch and cord are moved into the retracted position.

45. The gaming device of claim 44, wherein the switch and the at least one operational button are positioned along substantially the same line when the switch and cord are moved into the retracted position.

46. A gaming device controlled by the at least one processor and comprising:

a cabinet;

a game controlled by the at least one processor and operable upon a wager; and a switch including a plurality of operational buttons, said switch connected extendably and retractably to the cabinet via a cord and a mechanism operable to enable the cord to be pulled by a person to multiple predetermined extended positions defined by the mechanism and then released by the person, wherein the cord in each of the extended positions will thereafter recoil automatically to a fully retracted position, wherein only one of the operational buttons is operable by the person when the switch and cord are in the retracted position and wherein the only one operational button and at least another of the operational buttons are operable by the person when the switch and the cord are in the multiple extended positions.

* * * * *

UNITED STATES PATENT AND TRADEMARK OFFICE

CERTIFICATE OF CORRECTION

PATENT NO. : 7,309,286 B2
APPLICATION NO. : 10/661396
DATED : December 18, 2007
INVENTOR(S) : Joseph R. Hedrick et al.

It is certified that error appears in the above-identified patent and that said Letters Patent is hereby corrected as shown below:

IN THE SPECIFICATION:

In Column 3, Line 48 delete “is” between “10” and “preferably”.

In Column 7, Line 5 insert --invention-- between “present” and “is”.

Signed and Sealed this

Twenty-second Day of July, 2008

JON W. DUDAS
*Director of the United States Patent and Trademark Office*